US005548909A

United States Patent [19]

Foffano et al.

[11] Patent Number: 5,548,909

[45] Date of Patent: Aug. 27, 1996

[54] SPORTS SHOE HAVING AN ASYMMIETRICAL OPENING

[75] Inventors: Massimo Foffano; Giancarlo Foscaro; Faustino Lucchetta, all of Treviso, Italy

[73] Assignee: Nordica S.p.A., Trevignano, Italy

[21] Appl. No.: 223,882

[22] Filed: Apr. 6, 1994

[30] Foreign Application Priority Data

Apr. 9, 1993 [IT] Italy ..... TV93A0041

[51] Int. Cl.[6] ..... A43B 5/04; A43B 5/16

[52] U.S. Cl. ..... 36/117.6; 36/117.1

[58] Field of Search ..... 36/117, 118, 119, 36/120, 121, 45

[56] References Cited

U.S. PATENT DOCUMENTS

| | | | |
|---|---|---|---|
| 5,003,710 | 4/1991 | Pozzobon | 36/120 X |
| 5,189,815 | 3/1993 | Pozzobon et al. | 36/120 X |
| 5,228,219 | 7/1993 | Tonel | 36/117 |
| 5,329,706 | 7/1994 | Pozzobon | 36/118 X |

FOREIGN PATENT DOCUMENTS

| | | |
|---|---|---|
| 0302414 | 2/1989 | European Pat. Off. . |
| 0521288 | 1/1993 | European Pat. Off. . |
| 0551881 | 7/1993 | European Pat. Off. . |
| 0556799 | 8/1993 | European Pat. Off. . |
| 0572862 | 12/1993 | European Pat. Off. . |

*Primary Examiner*—B. Dayoan
*Attorney, Agent, or Firm*—Guido Modiano; Albert Josif

[57] ABSTRACT

Sports shoe, particularly usable for skiing or skating, including a shell with which at least one quarter is associable; the shell has a longitudinal opening that is asymmetrical toward the outer region of the foot. The opening can be temporarily closed by means of at least one flap which is preferably made of a less rigid material than the shell. The sports shoe thus has components that selectively comply with the various technical requirements during sports practice.

21 Claims, 13 Drawing Sheets

SPORTS SHOE HAVING AN ASYMMIETRICAL OPENING

BACKGROUND OF THE INVENTION

The present invention relates to a sports shoe particularly usable for skiing or skating.

Currently, it is known to manufacture for these two sports a shoe which usually comprises a shell made of plastics with which at least one quarter, also made of plastics, is associable.

Particularly in skiing, the skier needs to transfer from the foot to the ski all the forces required for correct sports practice.

There is also the problem of combining good comfort of the boot with the possibility of easy insertion of the foot inside the boot.

U.S. Pat. No. 3,325,920 discloses a ski boot comprising a rigid outer shell in which a lateral opening is formed at the inner foot region by virtue of a swinging element that is pivoted to the shell.

This solution is structurally very complicated, since it requires the presence of various elements that must be pivoted and temporarily coupled to one another to allow the skier to the practice sport comfortably; this solution furthermore requires covering elements to provide watertightness.

Lateral entry of the foot is thus not easy for the user due to the large number of actions he must perform to achieve this insertion: furthermore, it should be stressed that the rigidity of the shell in all its parts limits its comfort during sports practice.

Furthermore, there is the drawback due to the fact that forces are not optimally transferred from the boot to the ski, since the swinging element tends to open under stress.

U.S. Pat. No. 3,405,463 also relates to a ski boot having a rigid shell to which a swinging element is hinged in the rear lateral region so as to provide an opening at the inner lateral foot region.

This solution, too, has the above-described drawbacks, with the addition of the fact that, as in the previous case, forces are not transferred well from the boot to the ski, since the swinging element tends to open under stress.

SUMMARY OF THE INVENTION

The aim of the present invention is to eliminate the described technical problems, solving the drawbacks of the above-mentioned prior art by a sports shoe that provides the user with optimum transfer of forces during sports practice.

Within the scope of this aim, an important object is to provide a sports shoe that allows easy insertion and good comfort for the foot.

An important object is to provide a sports shoe that associates with the preceding characteristics that of having modest manufacturing costs.

Another object is to provide a sports shoe that keeps the lateral regions of the foot in an optimum securing position during sports practice.

With this aim and these objects in view, there is provided, according to the present invention, a sports shoe, particularly for skiing or skating, that comprises a shell with which at least one quarter is associable, characterized in that said shell has a longitudinal opening that is asymmetrical toward the outer lateral region of the foot and can be temporarily closed by means of at least one applied flap preferably made of a material that is less rigid than the material of said shell.

BRIEF DESCRIPTION OF THE DRAWINGS

Further characteristics and advantages of the invention will become apparent from the following detailed description of some particular but not exclusive embodiments thereof, illustrated only by way of non-limitative example in the accompanying drawings, wherein.

DESCRIPTION OF THE PREFERRED EMBODIMENTS

Figure 3:
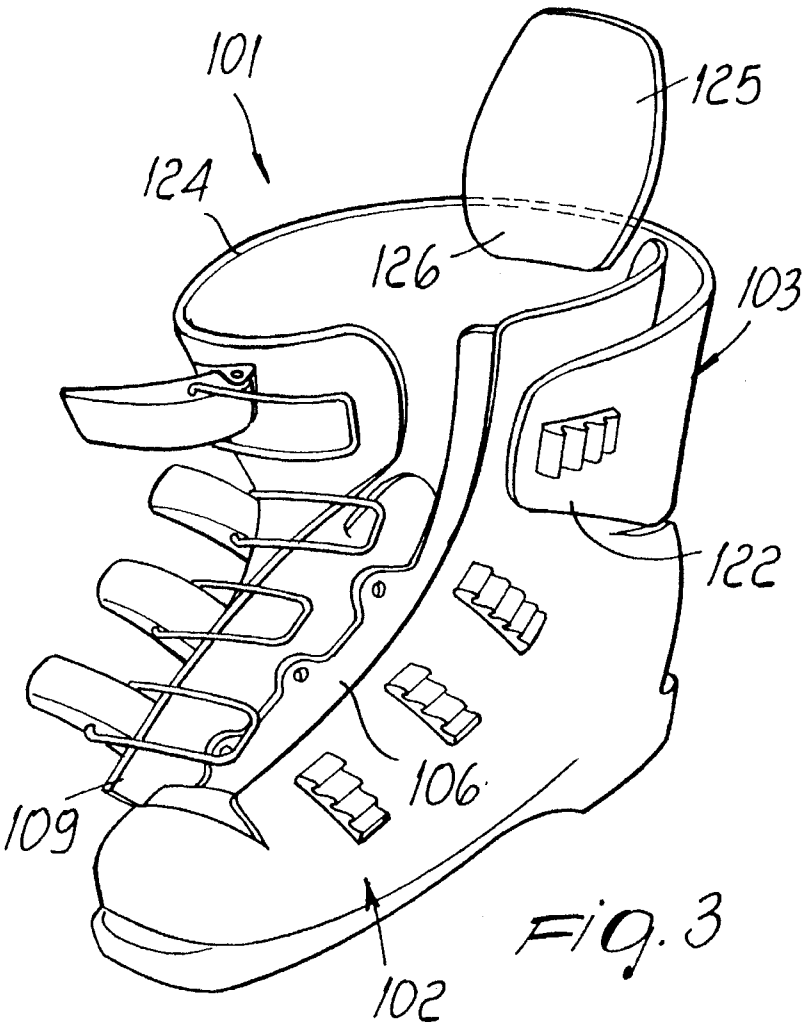
FIG. 3 is a view, similar to FIG. 1, of a further embodiment of the ski boot according to the invention.
Figure 1:
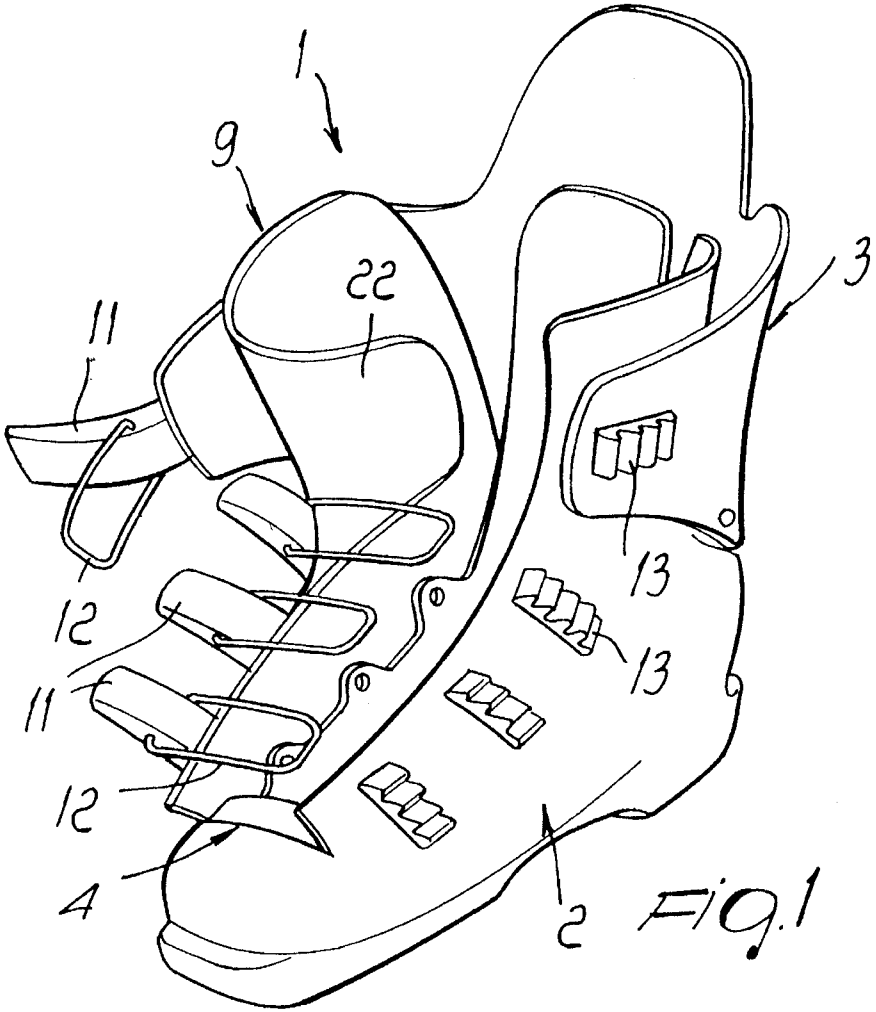
FIG. 1 is a perspective view of a ski boot in open condition, according to the invention.
Figure 2:
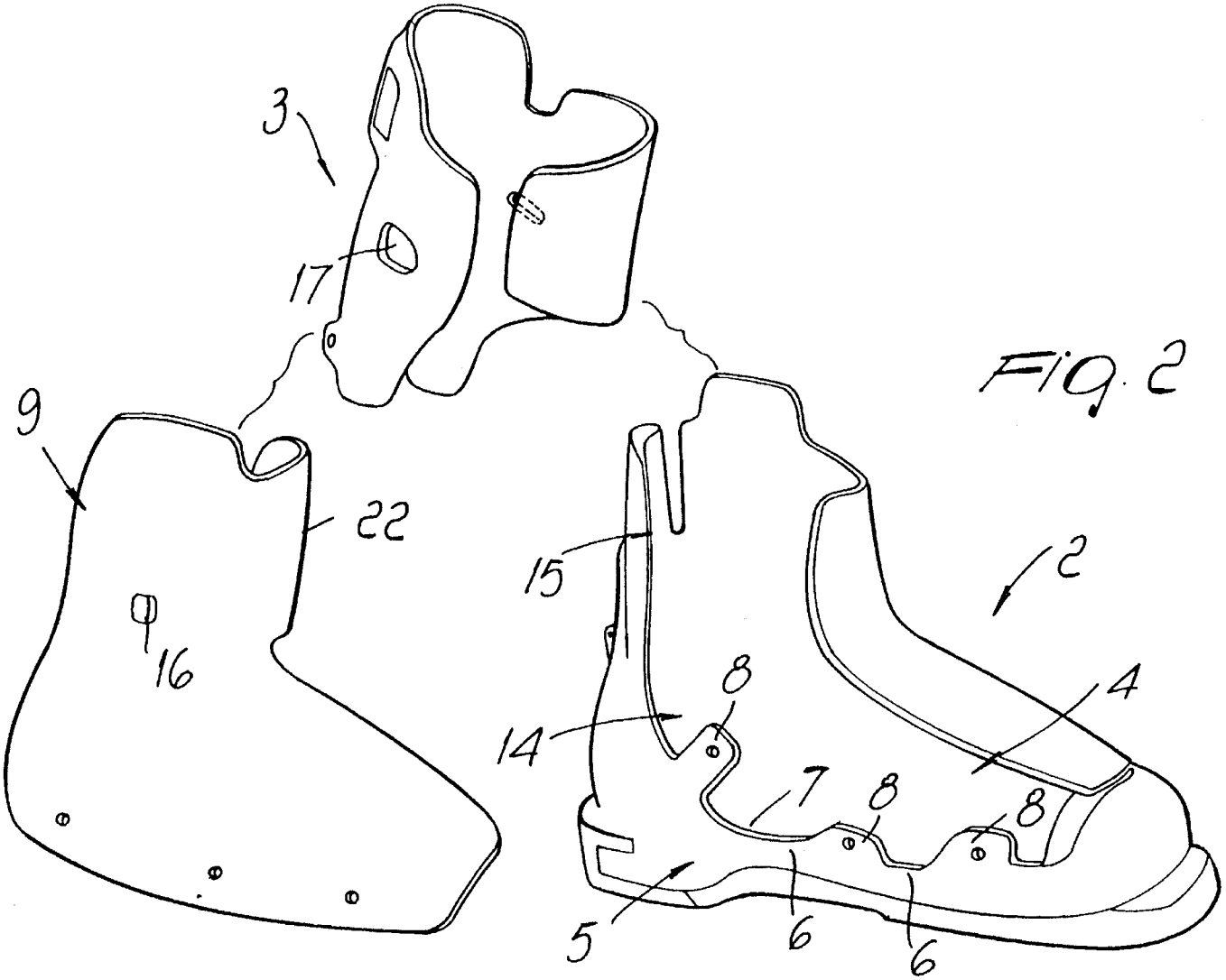
FIG. 2 is an exploded view of the ski boot of the preceding figure.
Figure 5:
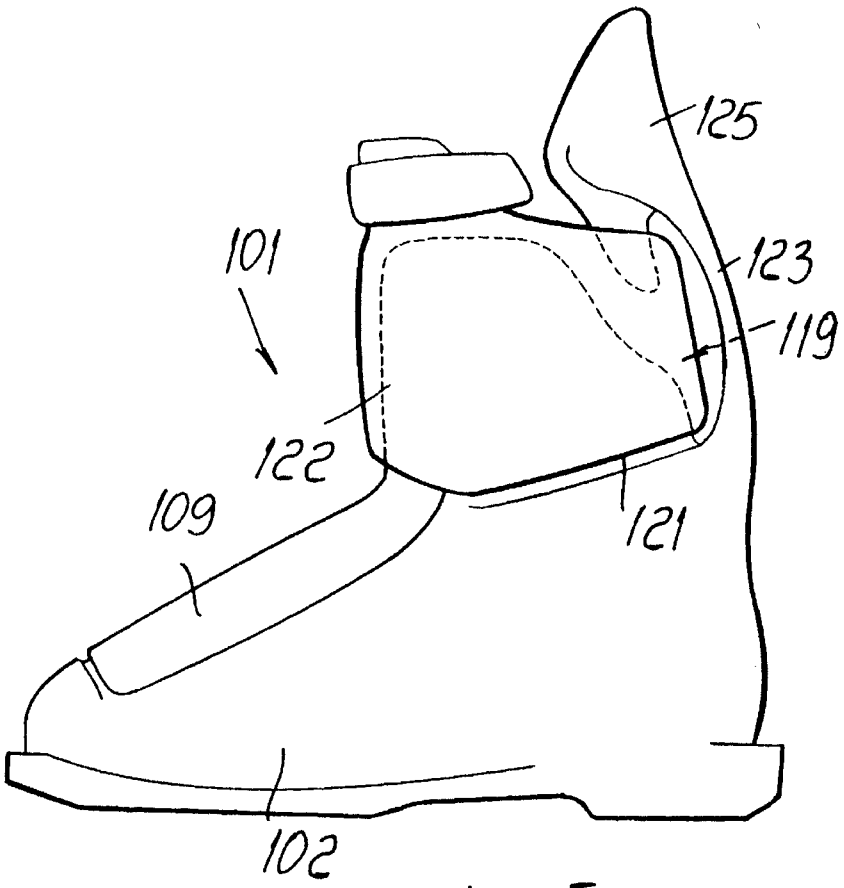
FIG. 5 is the opposite side view of the ski boot of FIG. 4.
Figure 4:
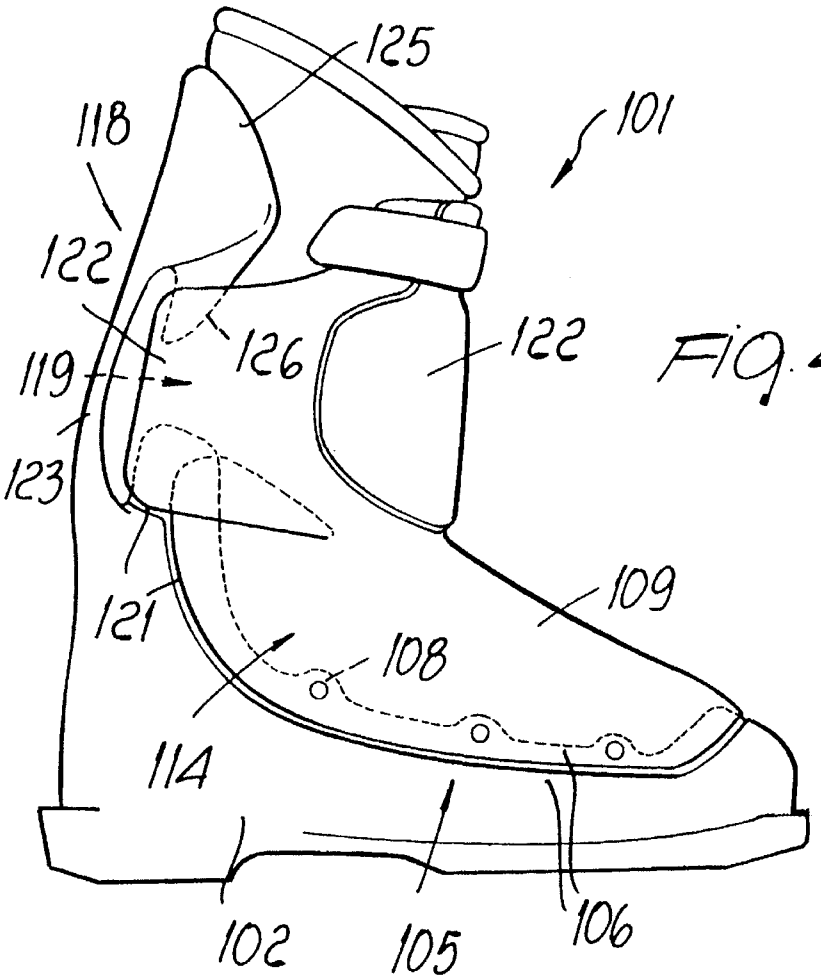
FIG. 4 is a side view of the ski boot of FIG. 3.
Figure 7:
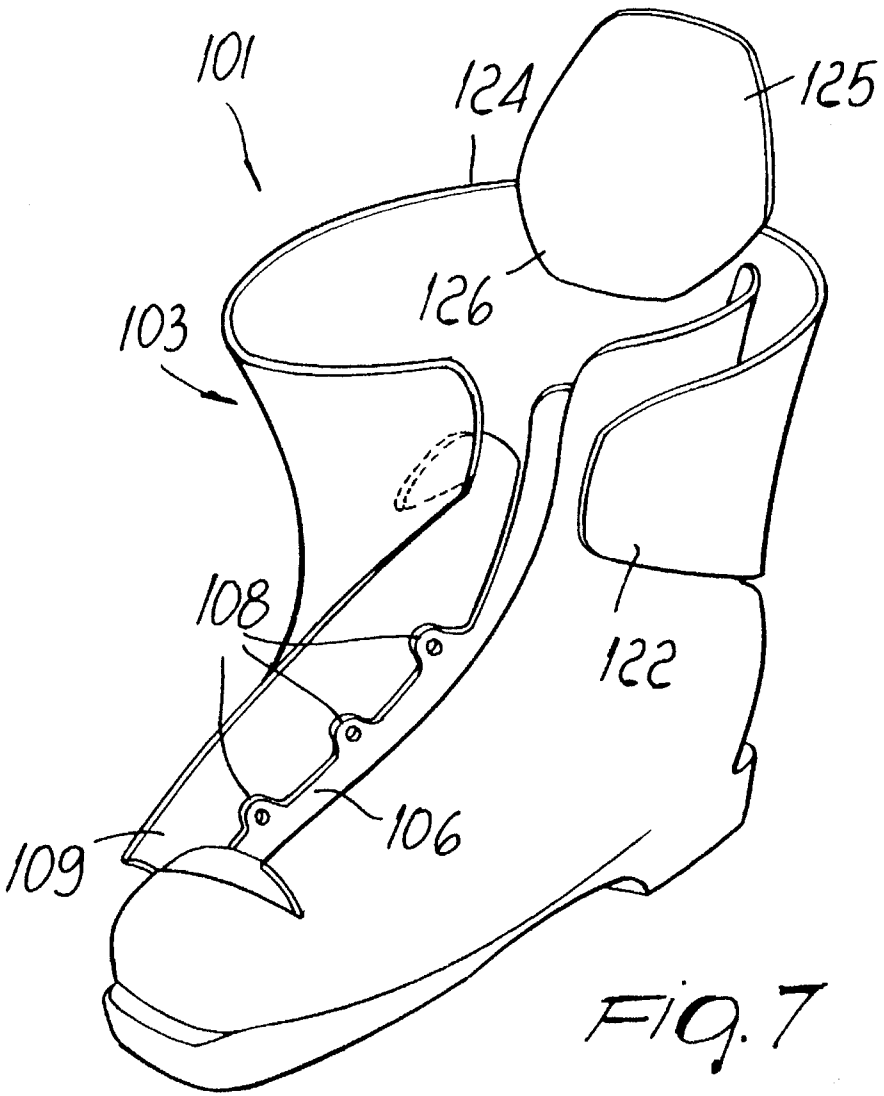
FIG. 7 is a perspective view of the ski boot according to the embodiment of FIG. 3, wherein levers and racks have been omitted for the sake of clarity.
Figure 6:
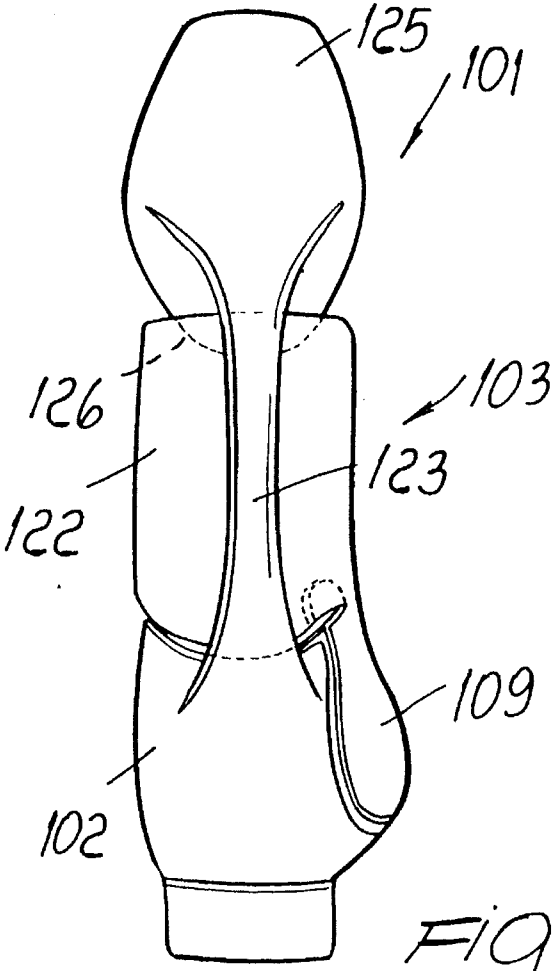
FIG. 6 is a rear view of the ski boot of FIG. 3.
Figure 9:
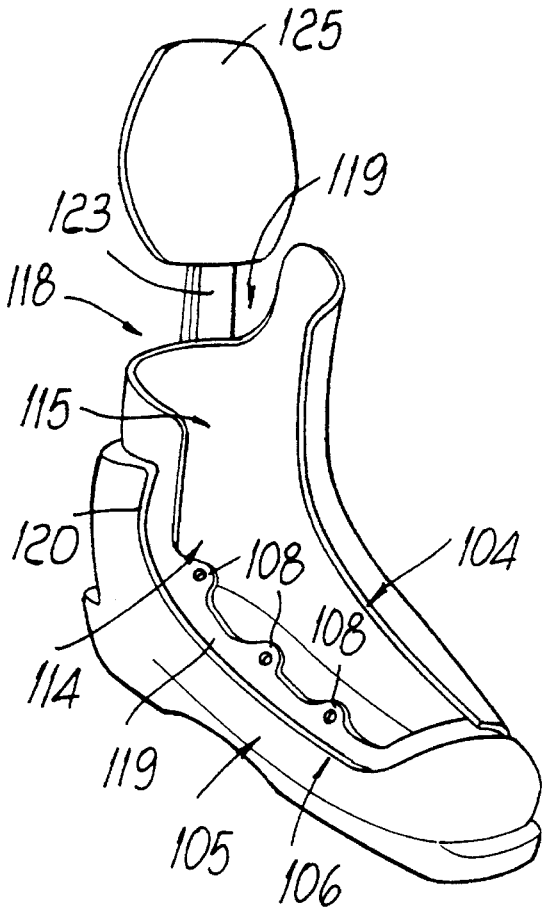
FIG. 9 is another front perspective view of the ski boot according to the embodiment of FIG. 7.
Figure 8:
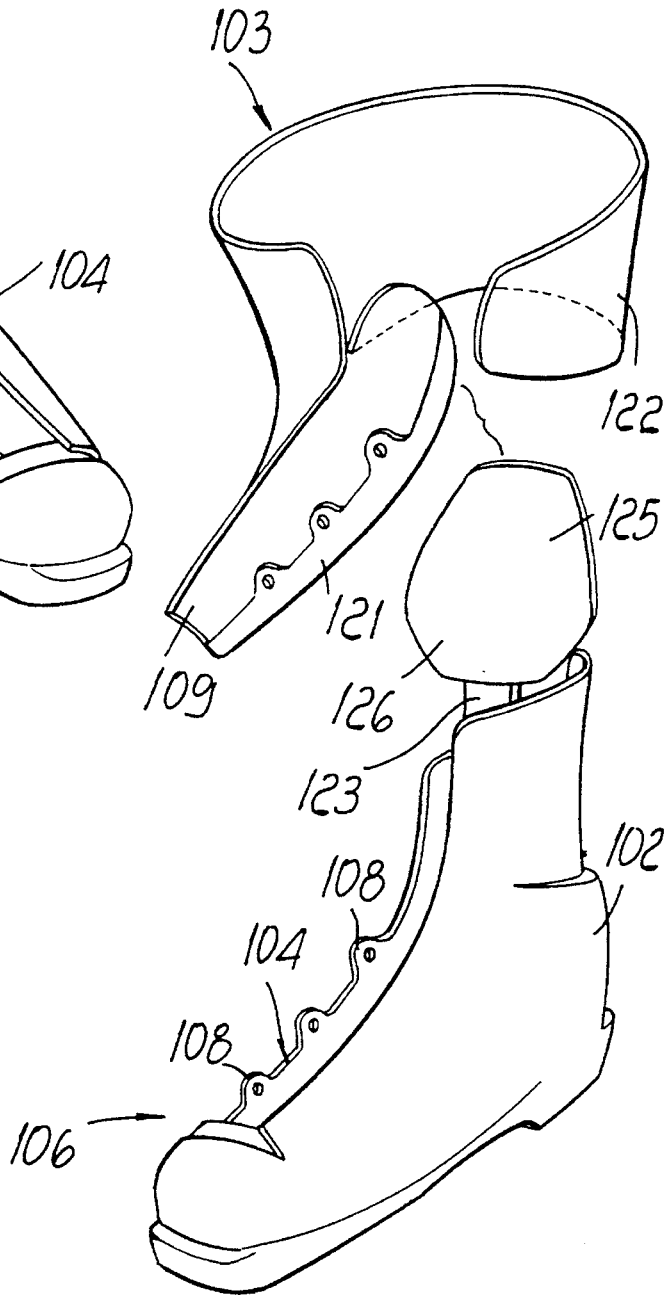
FIG. 8 is an exploded view of the ski boot of FIG. 7.
Figure 11:
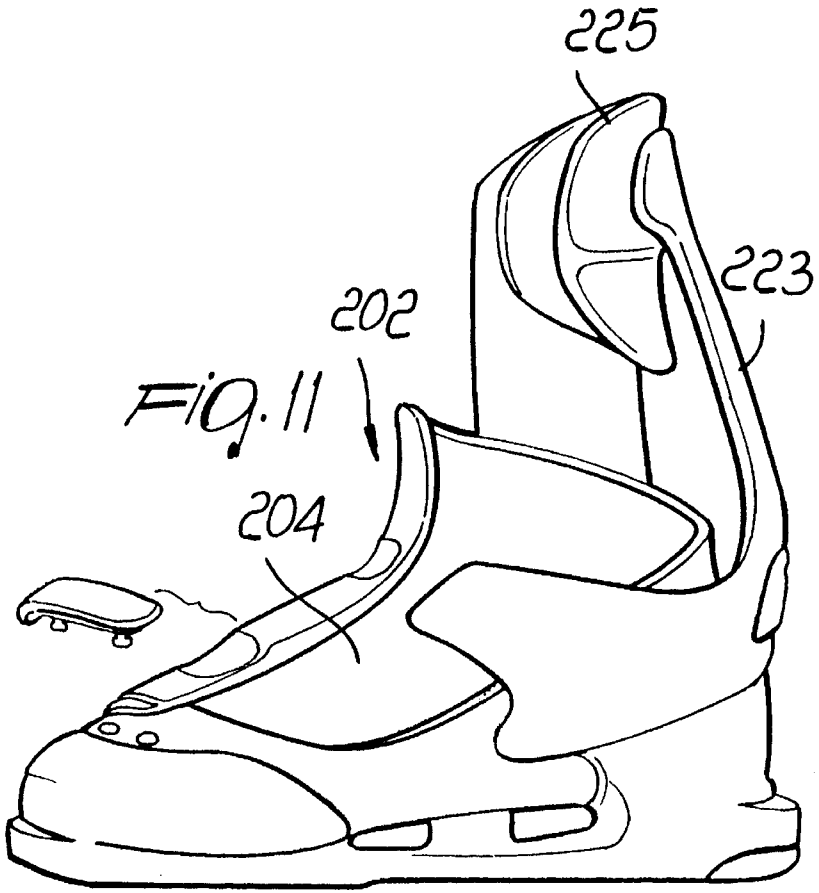
FIG. 11 is a side view of the shell of the boot of FIG. 10.
Figure 10:
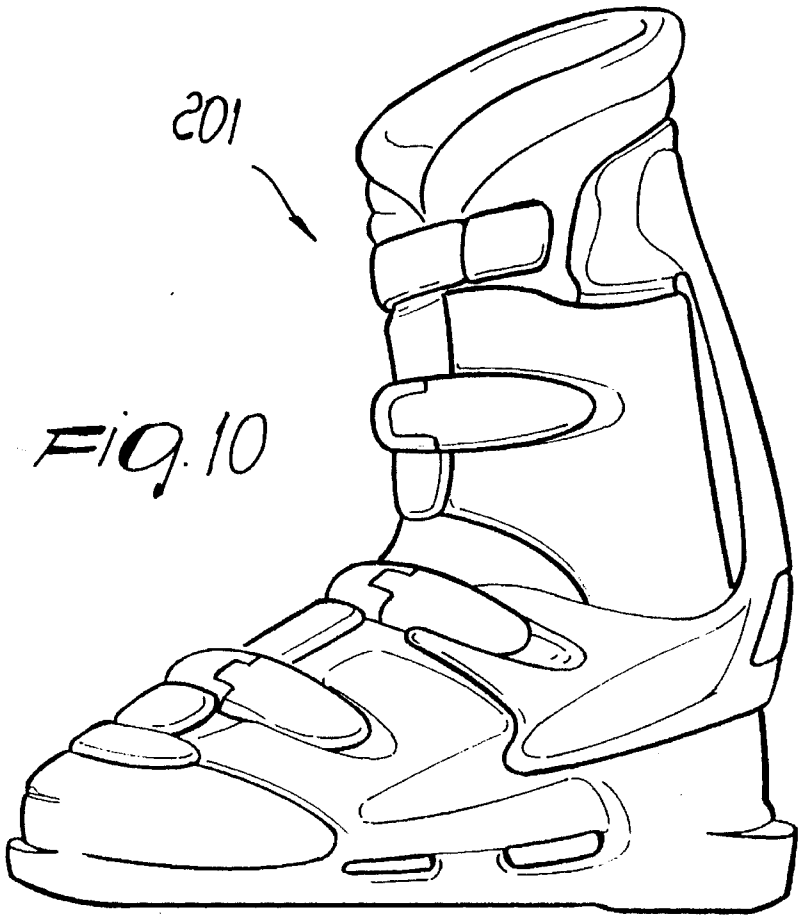
FIG. 10 is a side view of a ski boot according to a third aspect of the invention.

With reference to the above figures, a sports shoe, particularly a ski boot 1, is constituted by a shell 2 with which at least one quarter 3 is associable.

The shell 2, preferably made of rigid plastics, has an asymmetrical longitudinal opening 4.

This asymmetry occurs toward the outer lateral region 5 of the foot, where a wall 6 protrudes slightly from the sole; one or more tabs 8 protrude from the perimetric edge 7 of said wall and constitute means that allow association of an applied flap 9 preferably made of a less rigid material than the shell 2.

The shape of the applied flap 9 allows temporary closing of the opening and securement of said flap to the shell by means of adapted known levers 11 provided with tensioning elements 12 that interact for example with adapted racks 13 associated with the shell or with the quarter.

In the illustrated embodiment, the opening effects the outer lateral region 5 of the foot, the lateral region 14 of the outer malleolus, and the lateral region 15 of the adjacent part of the leg.

Advantageously, the applied flap 9, in addition to allowing closure of the opening 4, has an upper tab 22 that surrounds the front part of the leg until it overlaps the shell.

The particular configuration and arrangement of the opening 4, together with the fact that the applied flap is made of a soft material, allow the user to provide access to the entire opening in order to insert or remove the foot, although optimum transfer of the forces from the foot to the underlying ski, wheels, or blade is nevertheless ensured, since in any case the inner lateral region of the foot and part of the outer lateral region thereof interact with the shell and the wall 6, which are more rigid, during sports practice; the underlying implement is in fact maneuvered with the inner part of the foot and the outer part simply provides stability.

The quarter 3 is preferably pivoted to the shell 2; advantageously, at least one lug 16 protrudes from the applied flap 9 and is located at a slot 17 that is formed laterally to said quarter 3 in order to allow its oscillation and ensure rear support.

It has thus been observed that the invention has achieved the intended aim and objects, a sports shoe having been obtained that has functional parts and covering parts as well as a rigid lateral part on the inner side of the foot that is suitable for maneuvering the ski or skate and a lateral part on the outer side of the foot that is obtained by means of a soft applied securing and covering flap. The asymmetry of the shell provides a shoe, the components whereof selectively comply with the various technical requirements of force transfer for maneuvering the ski or skate and of comfort for the securing and covering of the foot during sports practice.

In any case it is stressed that during the closure of the levers the soft flap pushes the foot laterally toward the rigid part of the shell so as to increase the possibility of optimum transfer of forces to the ski or skate.

The shoe according to the invention is naturally susceptible to numerous modifications and variations, all of which are within the scope of the same inventive concept.

For example, FIGS. 3–9 illustrate another embodiment for a ski boot 101 that is constituted by a shell 102 with which at least one quarter 103 is associable.

The shell 102, made of rigid plastics, has an asymmetrical opening 104 in which the asymmetry lies toward the outer lateral region 105 of the foot.

The opening 104 thus effects, in addition to this region, the lateral malleolar region 114 and the lateral region 115 of the adjacent part of the leg.

Furthermore, a recess 119 is formed in the region overlying the ankle, at the rear region 118 of the shell 102.

A thinner region is formed on the wall 106 and affects the outer lateral region 105 of the foot, the outer lateral malleolar region 114, the lateral region 115 of the adjacent part of the leg, and the rear region 118 where the recess 119 is formed.

A step 120 is thus formed for the resting of the lower perimetric edge 121 of the quarter 103, which is made of a softer material than the shell 102 so as to form a flap having such a shape that it can be associated on one side at the tabs 108 that protrude from the wall 106 and that it allows, on the other side, temporary closure of the opening 104 by means of a flap 109 provided with an upper tab 122 that surrounds the front region of the shell, both lateral regions and the rear region thereof.

This applied flap thus has the main function of the quarter but at the same time is also made of a softer material and is consequently less onerous from the point of view of production.

Advantageously, a longitudinal support 123 protrudes to the rear of the shell 102; a tongue or spoiler 125 for supporting the skier's leg is present at the free end of said support, which lies above the upper perimetric edge 124 of the quarter 103 once the shell 102 is associated.

Said tongue has such a shape that the upper part of the quarter 103, constituted by the tab 122, can be arranged between the lower end 126 of said tongue and the longitudinal support 123; said tab 122 can be secured by means of known levers.

This embodiment, too, solves the described technical problem, reducing costs by virtue of the fact that the applied flap also forms the quarter of the boot.

FIGS. 10 to 13 show a ski boot 201, according to a further aspect of the invention, comprising a shell 202 and a quarter 203. The shell 202 comprises an asymmetrical lateral opening 204 preferably at the outer lateral region of the foot.

The shell 202 also comprises a rear support 223 having a spoiler member 225. At the inner lateral region, the shell 202 comprises a tab 239 which is L-shaped and advantageously connected to the base of the shell and to the spoiler member 225.

Figure 13:
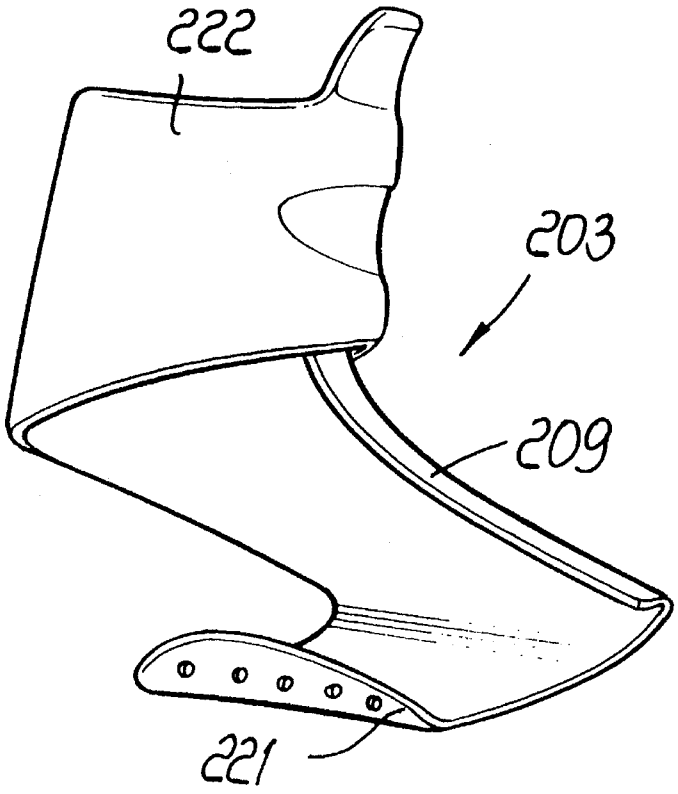
FIG. 13 is a side view of the quarter of the boot of FIG. 10.
Figure 12:
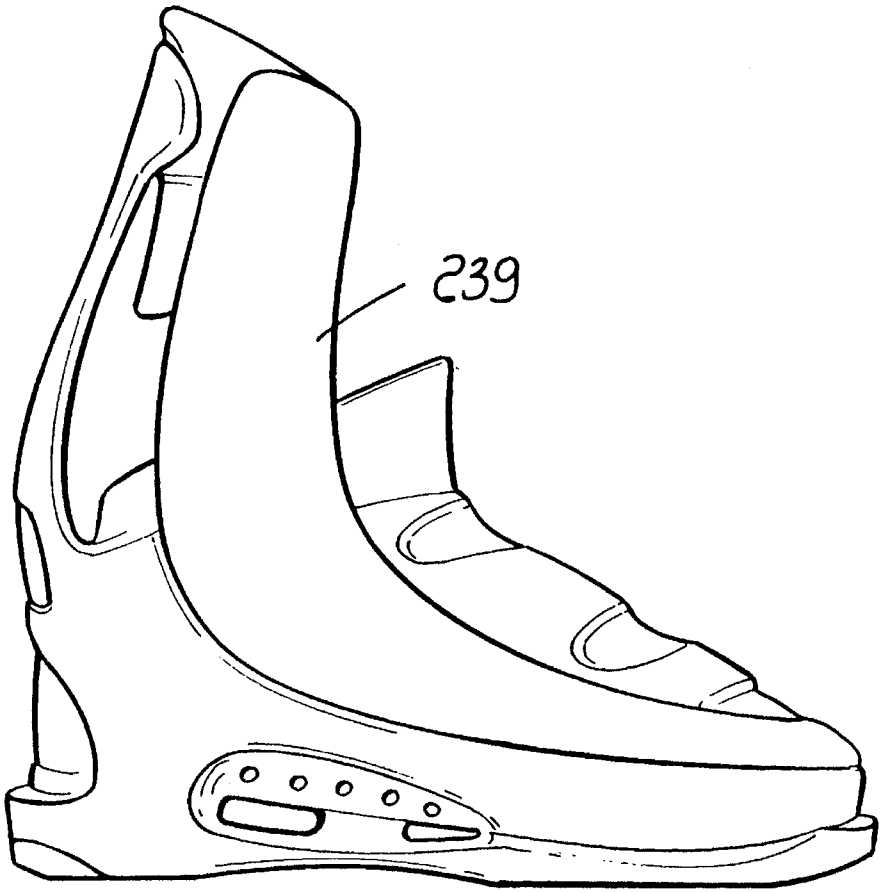
FIG. 12 is a side view, opposite that of FIG. 11, of the shell of the boot of FIG. 10.

The quarter 203, illustrated in FIG. 13, comprises a base portion 221, a side portion, or flap, 209 and an upper portion 222. The base portion 221 is adapted to be associated with the shell 202 and comprises conventional fastening means, such as holes 208 for bolts (not illustrated).

The shell 202 and the L-shaped tab 239 provide the required stiffness to the boot while the quarter 203 allows an easy insertion of the foot and improved comfort.

Figure 14:
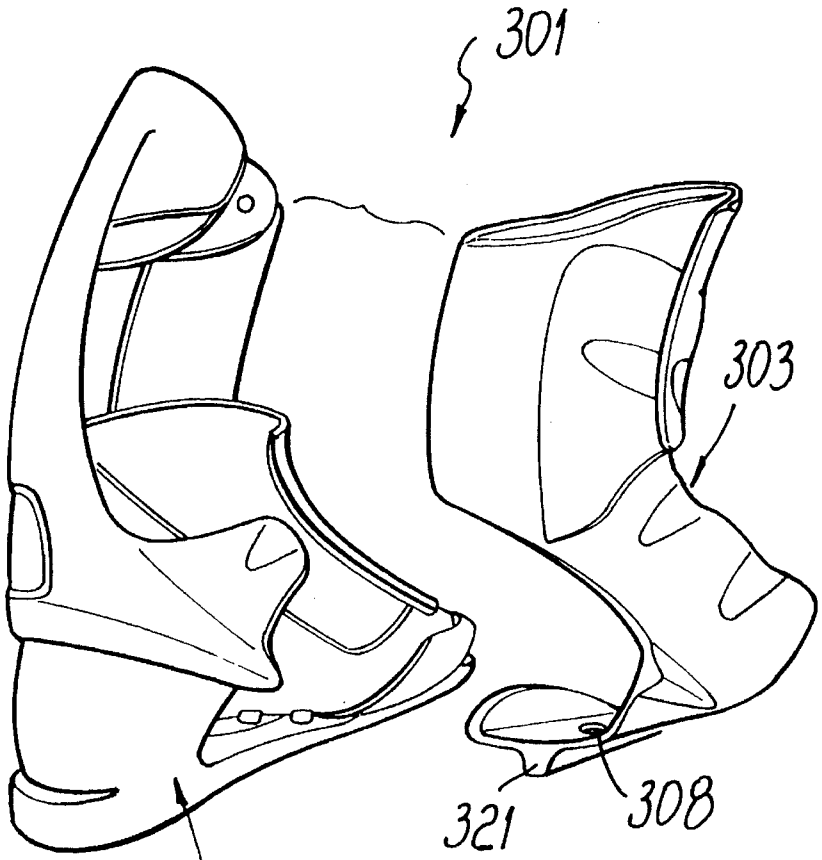
FIG. 14 is an exploded rear perspective view of a further embodiment of the invention.

FIG. 14 shows a boot 301 comprising a shell 302 and a quarter 303, substantially similar to the boot 201 described above.

The quarter 303 is in this case provided with a base ridge 321 and holes 308 for a snap-together connection with the shell 302.

Figure 15:
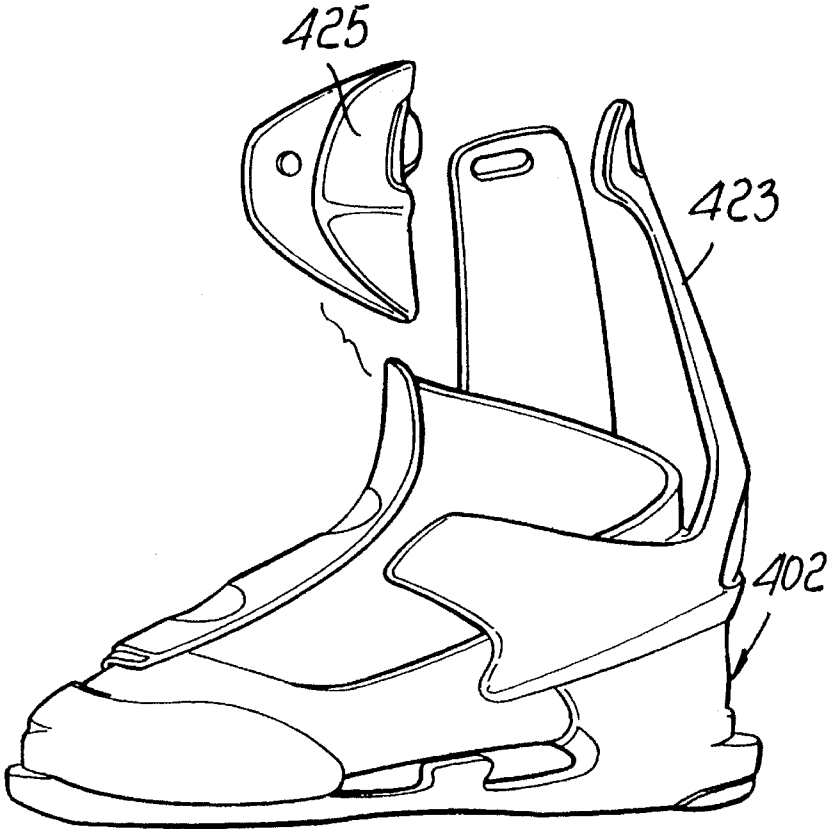
FIG. 15 is an exploded side perspective view of the shell of a boot according to a further aspect of the invention.

FIG. 15 shows a boot 401, substantially similar to the boots described above, and wherein the spoiler member 425 is provided as a separate piece from the shell 402. Advantageously, the spoiler 425 can swing with respect to the rear support 423 thereby adapting to the shape of the user's leg.

Figure 16:
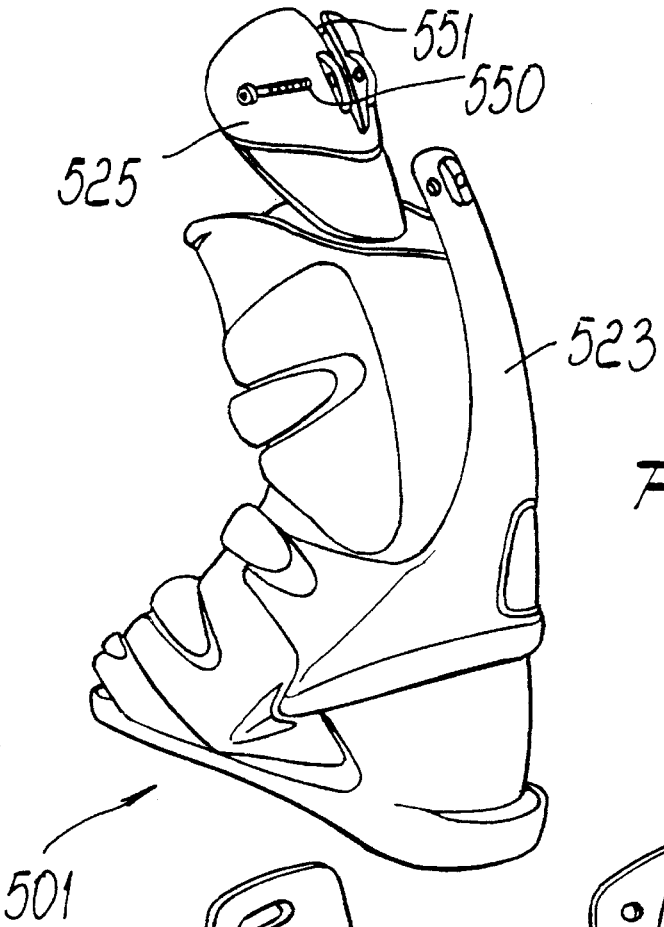
FIG. 16 is an exploded rear perspective view of the shell of a boot according to still a further aspect of the invention.

FIG. 16 shows a boot 501 substantially similar to the boot described above and wherein the spoiler member 525 has a longitudinal rear slot 551 and is pivoted to the rear support 523 by means of pivot means 550. The pivot means 550 comprises, for example, a bolt and screw adapted to connect the spoiler 525 to the rear support 523 and at the same time adapted to widen or narrow the spoiler size.

Figure 17:
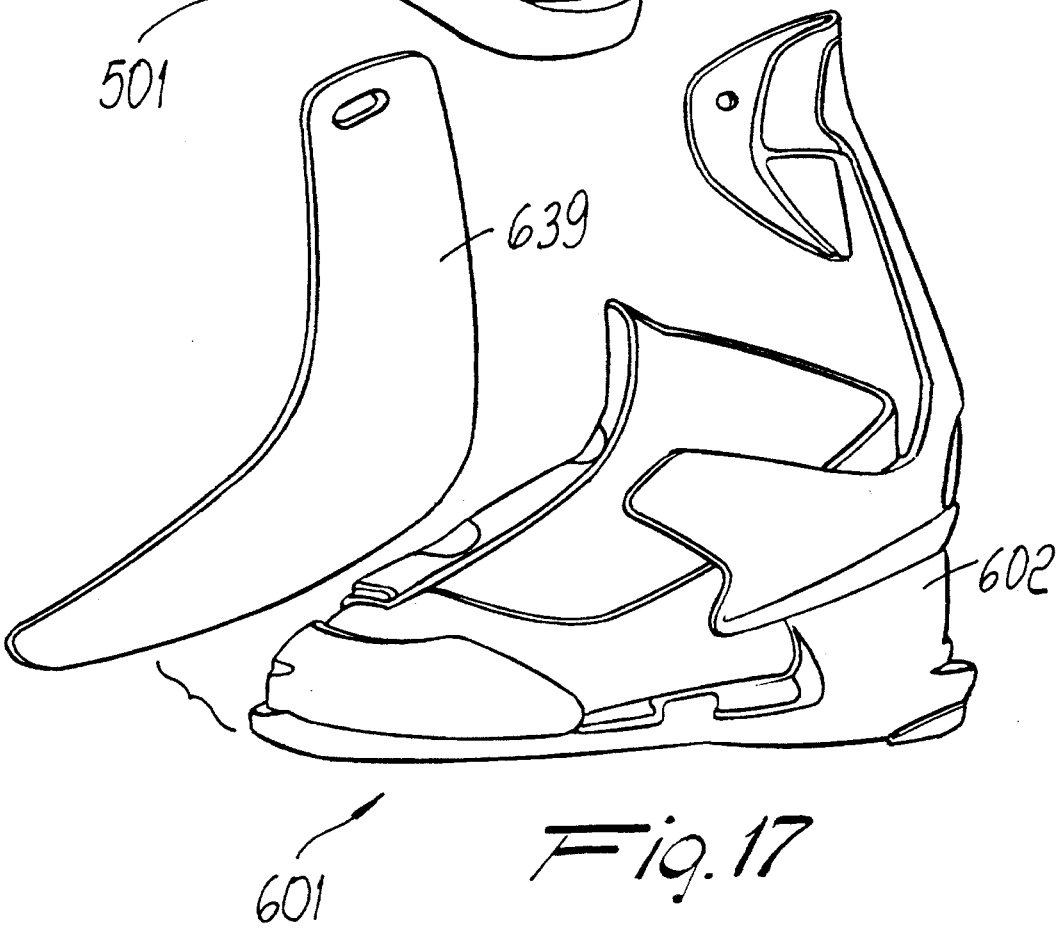
FIGS. 17 to 22 are exploded side perspective views of respective shells of further embodiments of the invention.

FIG. 17 shows a boot 601, substantially similar to the ones described above, and wherein the L-shaped lateral tab 639 is provided as a separate piece from the shell 602. In this case, the L-shaped tab may be easily provided in a different material from the shell, for example to improve stiffness.

Figure 18:
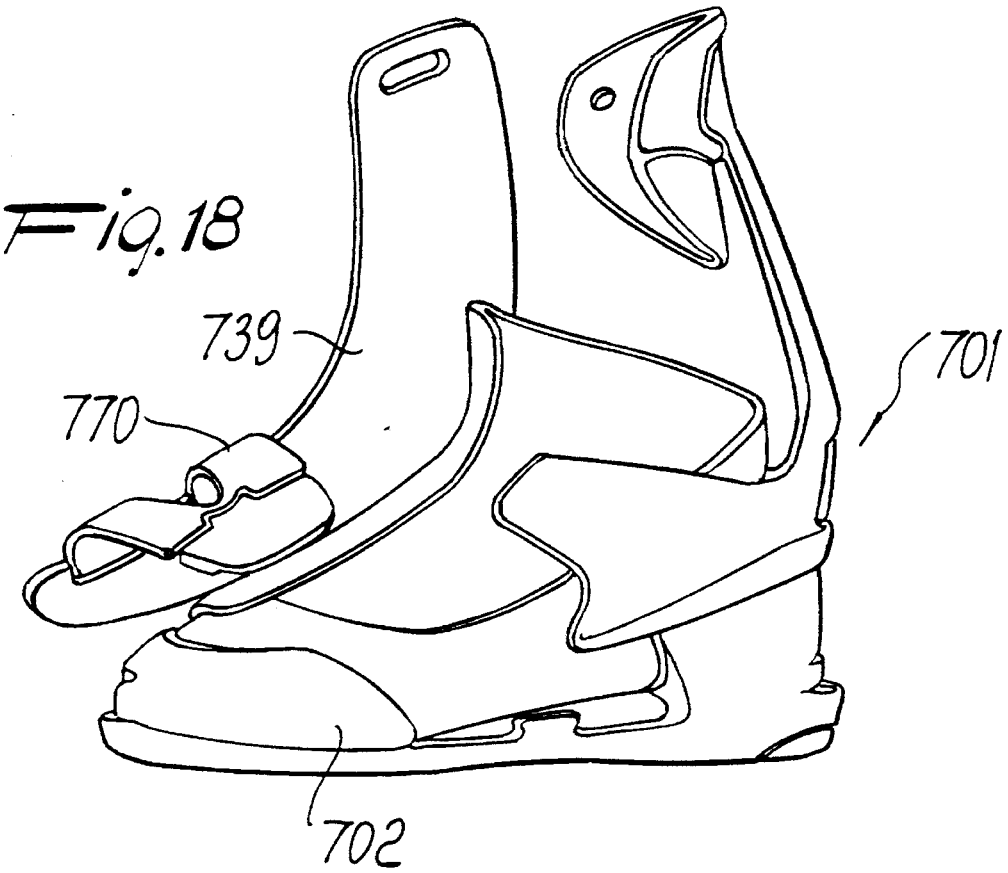

FIG. 18 shows a boot 701 wherein the L-shaped tab 739 and an upper front flap 770 are provided as a separate piece from the shell 702.

Figure 19:
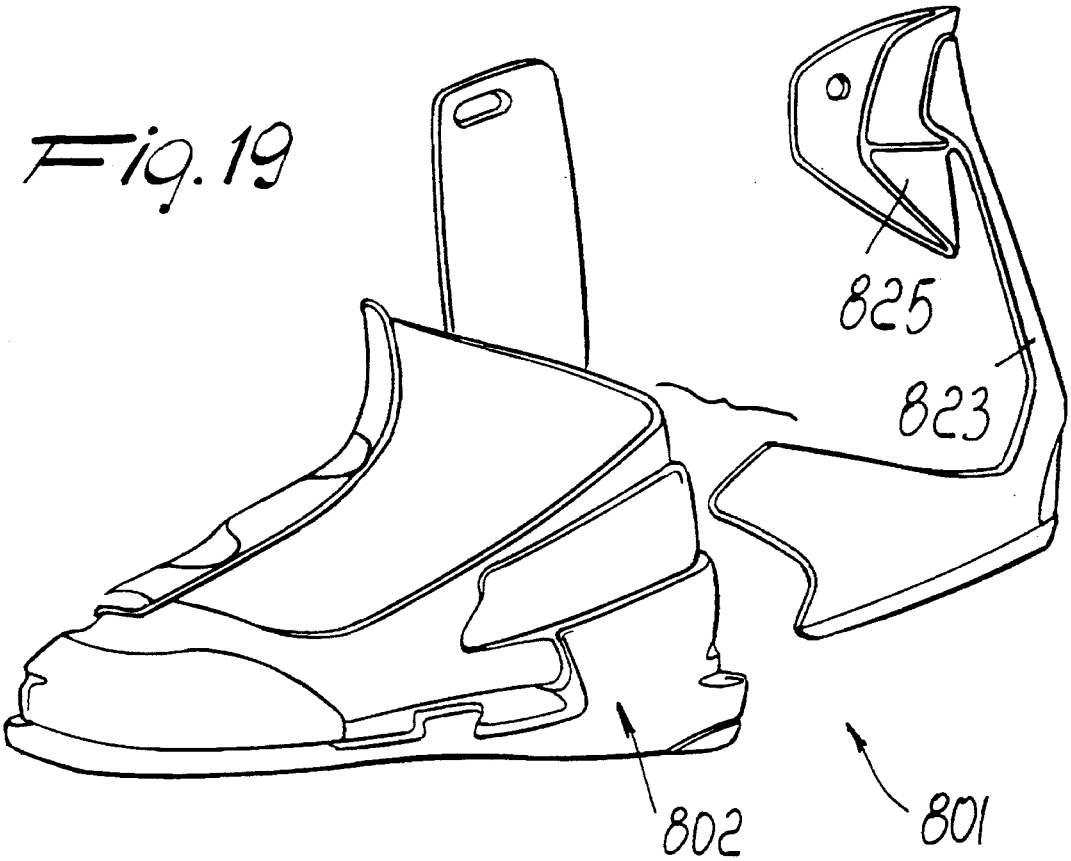

FIG. 19 shows a boot 801, wherein the rear support 823 and the spoiler member 825 are provided as a separate piece from the shell 802.

Figure 20:
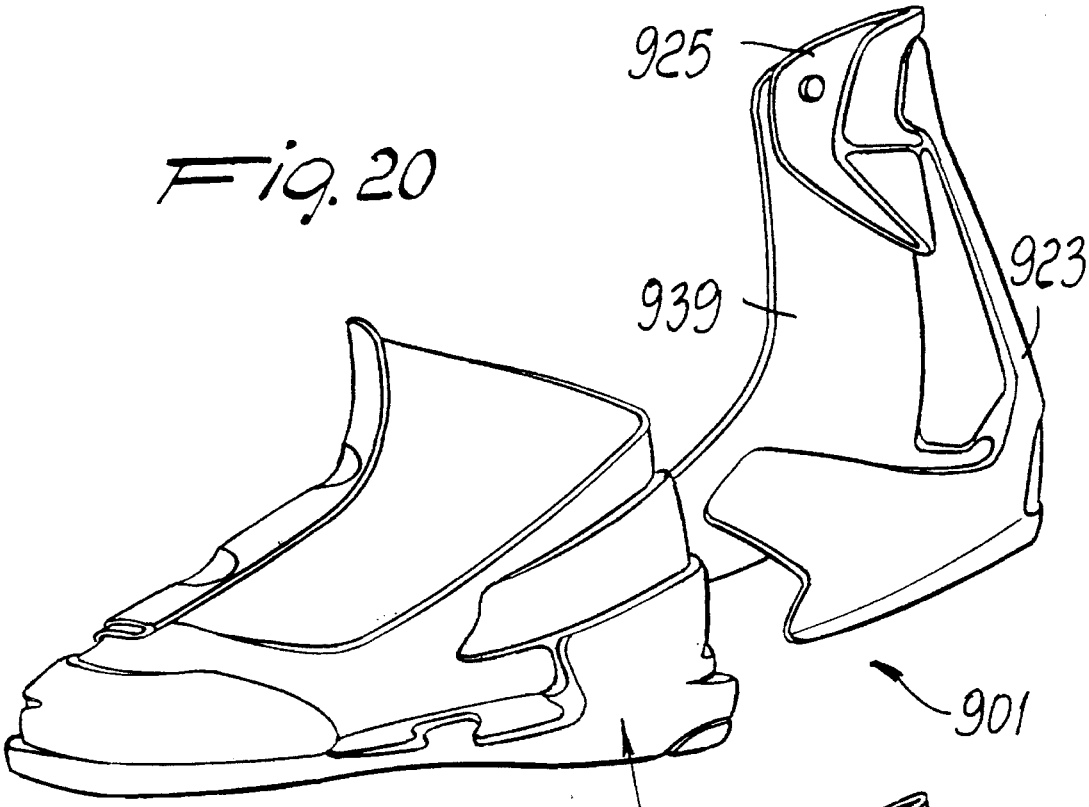

FIG. 20 shows a boot 901 wherein the rear support 923, the spoiler 925 and the L-shaped tab 939 are provided as a separate piece from the shell 902.

Figure 21:
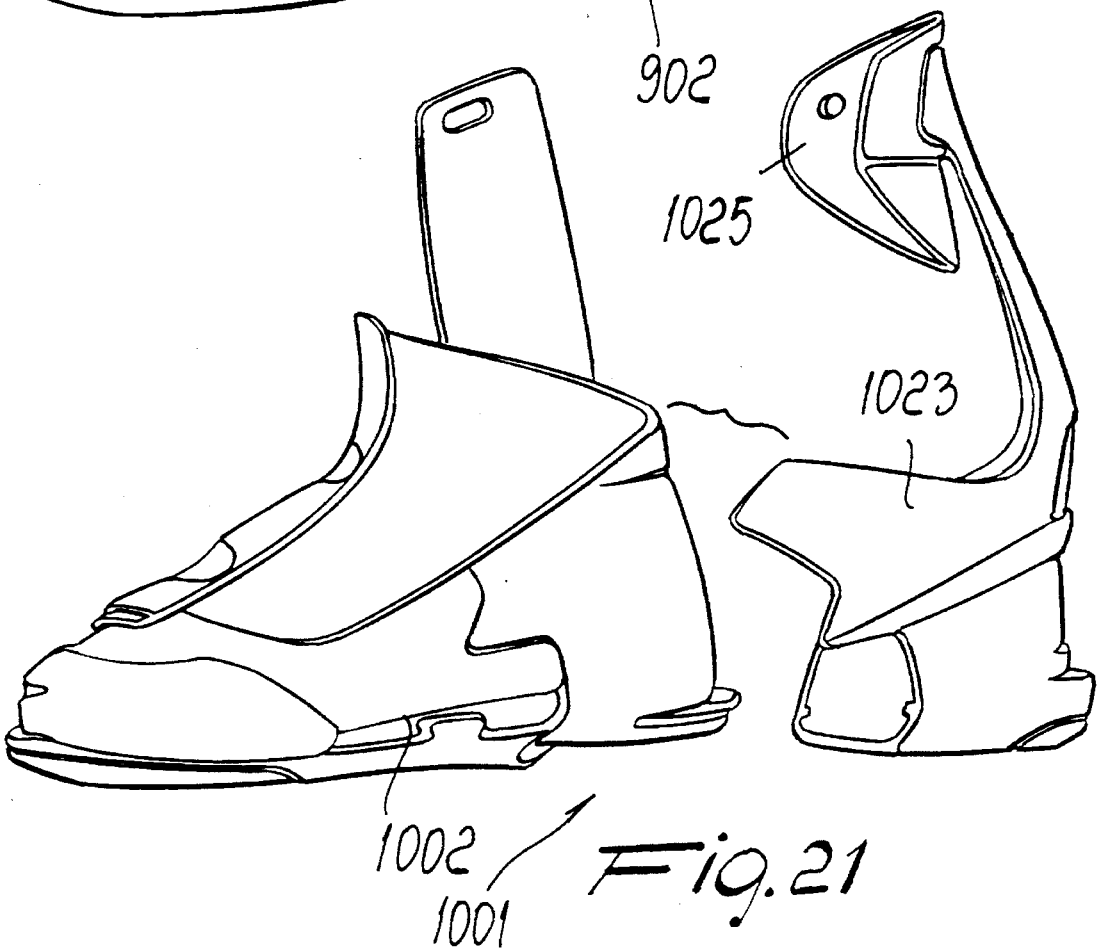

FIG. 21 shows a boot 1001 wherein the rear support 1023 and spoiler 1025 are provided as a separate piece from the shell 1002. The rear support 1023 also comprises a substantial portion of the rear part of the boot at the heel.

Figure 22:
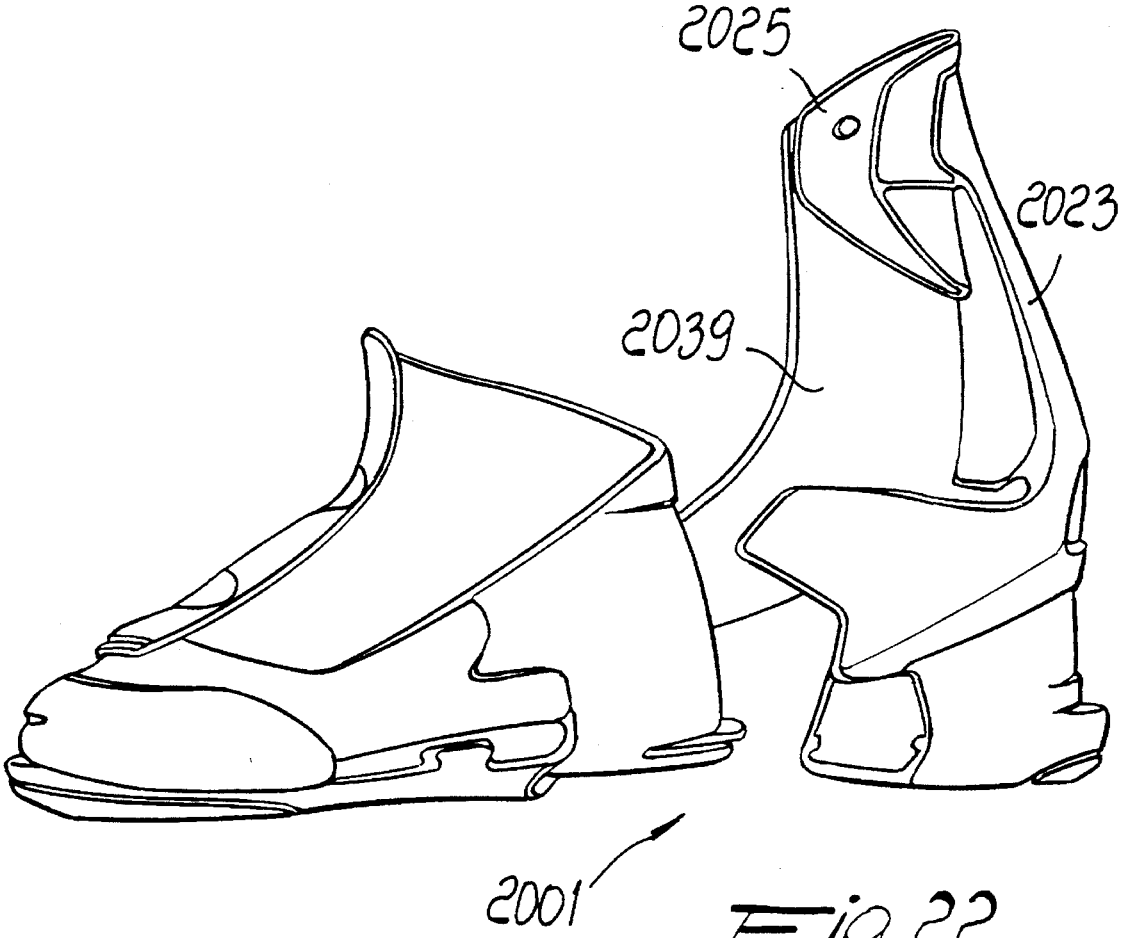

FIG. 22 shows a boot 2001 substantially similar to the boot described above and wherein the rear support 2023 and spoiler 2025 comprise the L-shaped tab 2039.

Figure 23:
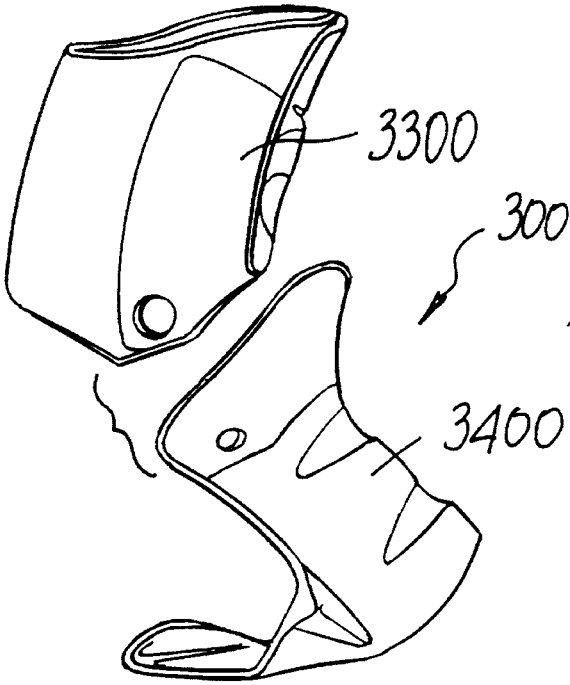
FIG. 23 is an exploded rear perspective view of a quarter of a boot according to a further aspect of the invention.

FIG. 23 shows a further embodiment of the quarter 3003 provided as two separate pieces 3300 and 3400. The quarter 3003 can be applied to any of the boots described above and has the advantage of allowing to easily use different materials for the different portions of the quarter.

Figure 24:
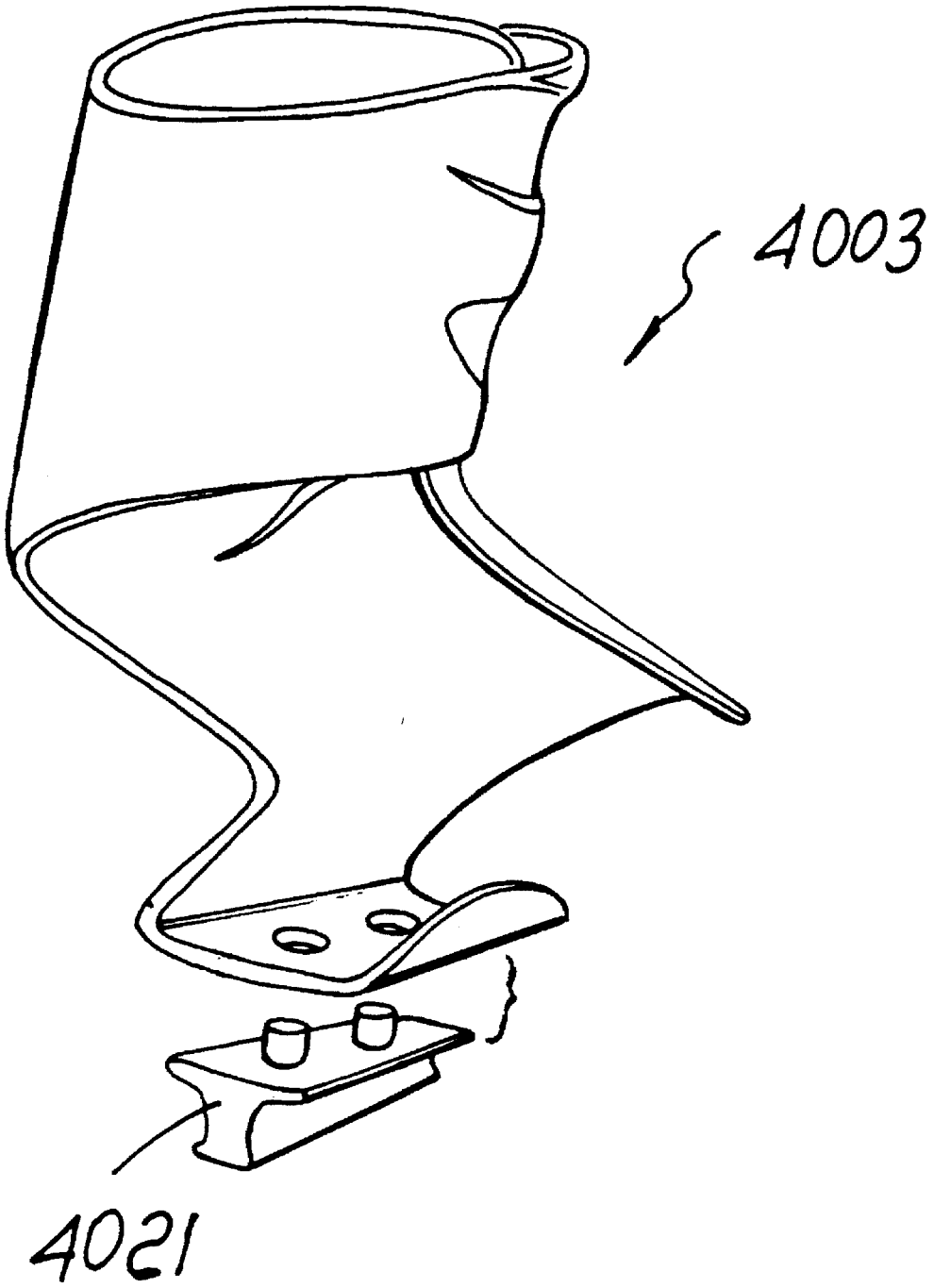
FIG. 24 is an exploded rear perspective view of a quarter of a boot according to a further aspect of the invention.

FIG. 24 shows a further embodiment of the quarter 4003 wherein the base portion comprises a shock absorber 4021 provided as a separate piece from the quarter. In this manner the shock absorber can be easily provided in different materials according to the requirements.

The boot according to the invention is naturally susceptible to many other modifications and variations, all of which are within the scope of the same inventive concept.

The materials and the dimensions of the individual components may naturally have the most appropriate densities and hardnesses according to the specific requirements.

We claim:

1. A sports shoe comprising a shell and a quarter, said shell and said quarter being mutually interconnected to form the sports shoe into which a user's foot and lower leg are insertable, the sports shoe comprising:

a sole region for surrounding a sole of a user's foot;

a toe region extending upwardly from a front region of said sole region for surrounding toes of a user's foot;

a heel region extending upwardly from a rear region of said sole region for surrounding a heel of a user's foot;

a medial arch region extending upwardly from an internal region of said sole region and extending between said toe region and said heel region for surrounding a medial arch of a user's foot;

a lateral arch region extending upwardly from an external region of said sole region and extending between said toe region and said heel region for surrounding a lateral arch of a user's foot;

a foot instep region extending from said toe region between said lateral and medial arch regions for surrounding an instep of a user's foot;

a front lower leg region extending upwardly from said foot instep region for surrounding a front portion of a user's lower leg;

a rear lower leg region extending upwardly from said heel region for surrounding a rear portion of a user's lower leg;

a medial lower leg region extending between said front and rear lower leg regions for surrounding a medial portion of a user's lower leg; and a lateral lower leg region extending between said front and rear lower leg regions for surrounding a lateral portion of a user's lower leg;

wherein said shell comprises:

a sole element arranged at said sole region for supporting a sole of a user's foot;

a front toe element arranged at said toe region for supporting toes of a user's foot;

a rear heel element arranged at said heel region for supporting a heel of a user's foot;

a first side element arranged at a first one of said medial and lateral arch regions, said first side element extending upwardly from said sole element between said heel element and said toe element and entirely over said first one of said medial and lateral arch regions, said first side element furthermore being arranged at and extending over at least a portion of said foot instep region, said first side element furthermore being arranged at and extending over at least a portion of a first one of said medial and lateral lower leg regions;

a second side element arranged at a second one of said medial and lateral arch regions, said second one of said medial and lateral arch regions being arranged opposite said first one of said medial and lateral arch regions, said second side element extending upwardly from said sole element between said heel element and said toe element and exclusively at a lower portion of said second one of said medial and lateral arch regions;

such that a longitudinal opening is provided in said shell, said longitudinal opening extending from said toe region towards said heel region and to a second one of said medial and lateral lower leg regions wherein said second one of said medial and lateral lower leg regions is arranged opposite said first one of said medial and lateral lower leg regions, said longitudinal opening extending between said first side element and said second side element at at least an upper portion of said second one of said medial and lateral arch regions, said longitudinal opening furthermore extending at at least a portion of said second one of said medial and lateral lower leg regions;

and wherein the sports shoe further comprises at least one flap element which is connected to said shell and which is arranged for releasably covering said longitudinal opening;

the sports shoe further comprising closure elements for releasably connecting said flap element in the shoe over said longitudinal opening.

2. The sports shoe of claim 1, wherein said flap element has a degree of rigidity which is less than a degree of rigidity of said shell.

3. The sports shoe of claim 1 wherein:

said first one of said medial and lateral arch regions is constituted by said medial arch region;

said second one of said medial and lateral arch regions is constituted by said lateral arch region said first one of said medial and lateral lower leg regions is constituted by said medial lower leg region; and said second one of said medial and lateral lower leg regions is constituted by said lateral lower leg region.

4. The sports shoe of claim 1 wherein said longitudinal opening extends at a portion of said foot instep region.

5. The sports shoe of claim 1 further comprising means for connecting said flap to said second side element of said shell.

6. The sports shoe of claim 5 wherein said second side element comprises a thin portion and a thick portion which mutually define a step for supporting an edge of said flap element.

7. The sports shoe of claim 1 wherein said flap element is an integral portion of said quarter, the sports shoe further comprising means for connecting said quarter to said shell.

8. The sports shoe of claim 7 wherein said means for connecting said quarter to said shell comprise a base portion integrally formed with said quarter and arranged adjacent said sole element of said shell.

9. The sports shoe of claim 1 wherein said flap element is a separate piece from said quarter, the sports shoe further comprising means for connecting said quarter to said flap element and to said shell.

10. The sports shoe of claim 1 wherein all of said elements of said shell are formed integrally together to form a single-piece integral shell.

11. The sports shoe of claim 1 wherein said shell further comprises a rear lower leg element arranged at at least a portion of said rear lower leg region for supporting at rear portion of a user's lower leg.

12. The sports shoe of claim 11 wherein all of said elements of said shell are formed integrally together to form a single-piece integral shell.

13. The sports shoe of claim 1 further comprising an L-shaped tab associated with said first side element of said shell, and a rear spoiler associated with said L-shaped tab and with said rear heel element of said shell.

14. A sports shoe comprising a shell and a quarter, said shell and said quarter being mutually interconnected to form the sports shoe into which a user's foot and lower leg are insertable, the sports shoe comprising:

a sole region for surrounding a sole of a user's foot;

a toe region extending upwardly from a front region of said sole region for surrounding toes of a user's foot;

a heel region extending upwardly from a rear region of said sole region for surrounding a heel of a user's foot;

a medial arch region extending upwardly from an internal region of said sole region and extending between said toe region and said heel region for surrounding a medial arch of a user's foot;

a lateral arch region extending upwardly from an external region of said sole region and extending between said toe region and said heel region for surrounding a lateral arch of a user's foot;

a foot instep region extending from said toe region between said lateral and medial arch regions for surrounding an instep of a user's foot;

a front lower leg region extending upwardly from said foot instep region for surrounding a front portion of a user's lower leg;

a rear lower leg region extending upwardly from said heel region for surrounding a rear portion of a user's lower leg;

a medial lower leg region extending between said front and rear lower leg regions for surrounding a medial portion of a user's lower leg; and a lateral lower leg region extending between said front and rear lower leg regions for surrounding a lateral portion of a user's lower leg;

wherein said shell comprises:

a sole element arranged at said sole region for supporting a sole of a user's foot;

a front toe element arranged at said toe region for supporting toes of a user's foot;

a rear heel element arranged at said heel region for supporting a heel of a user's foot;

a first side element arranged at a first one of said medial and lateral arch regions, said first side element extending upwardly from said sole element between said heel element and said toe element and entirely over said first one of said medial and lateral arch regions, said first side element furthermore being arranged at and extending over at least a portion of said foot instep region, said first side element furthermore being arranged at and extending over at least a portion of a first one of said medial and lateral lower leg regions;

a second side element arranged at a second one of said medial and lateral arch regions, said second one of said medial and lateral arch regions being arranged opposite said first one of said medial and lateral arch regions, said second side element extending upwardly from said sole element between said heel element and said toe element and exclusively at a lower portion of said second one of said medial and lateral arch regions;

such that a longitudinal opening is provided in said shell, said longitudinal opening extending from said toe region towards said heel region and to a second one of said medial and lateral lower leg regions wherein said second one of said medial and lateral lower leg regions is arranged opposite said first one of said medial and lateral lower leg regions, said longitudinal opening extending between said first side element and said second side element at at least an upper portion of said second one of said medial and lateral arch regions, said longitudinal opening furthermore extending at at least a portion of said second one of said medial and lateral lower leg regions;

and wherein the sports shoe further comprises means for releasably covering said longitudinal opening;

the sports shoe further comprising closure elements for releasably connecting said means for releasably covering said longitudinal opening in the shoe over said longitudinal opening.

15. The sports shoe of claim 14, wherein said means for releasably covering said longitudinal opening have a degree of rigidity which is less than a degree of rigidity of said shell.

16. The sports shoe of claim 14 wherein:

said first one of said medial and lateral arch regions is constituted by said medial arch region;

said second one of said medial and lateral arch regions is constituted by said lateral arch region said first one of said medial and lateral lower leg regions is constituted by said medial lower leg region; and said second one of said medial and lateral lower leg regions is constituted by said lateral lower leg region.

17. The sports shoe of claim 14 wherein said longitudinal opening extends at a portion of said foot instep region.

18. The sports shoe of claim 14 wherein all of said elements of said shell are formed integrally together to form a single-piece integral shell.

19. The sports shoe of claim 14 wherein said shell further comprises a rear lower leg element arranged at at least a portion of said rear lower leg region for supporting at rear portion of a user's lower leg.

20. The sports shoe of claim 19 wherein all of said elements of said shell are formed integrally together to form a single-piece integral shell.

21. The sports shoe of claim 14 further comprising an L-shaped tab associated with said first side element of said shell, and a rear spoiler associated with said L-shaped tab and with said rear heel element of said shell.

* * * * *